US007258344B2

(12) United States Patent
Giegerich et al.

(10) Patent No.: US 7,258,344 B2
(45) Date of Patent: Aug. 21, 2007

(54) ELECTRONICALLY-SCORED GAME PROVIDING AUDIBLE FEEDBACK AND METHOD OF USE

(75) Inventors: Gary D. Giegerich, North Woods, PA (US); Paul Giegerich, Laverock, PA (US)

(73) Assignee: DMI Sports, Inc., Fort Washington, PA (US)

( * ) Notice: Subject to any disclaimer, the term of this patent is extended or adjusted under 35 U.S.C. 154(b) by 545 days.

(21) Appl. No.: 10/665,002

(22) Filed: Sep. 18, 2003

(65) Prior Publication Data

US 2004/0140620 A1 Jul. 22, 2004

Related U.S. Application Data

(60) Provisional application No. 60/440,708, filed on Jan. 16, 2003.

(51) Int. Cl.
*F41J 5/00* (2006.01)

(52) U.S. Cl. ..... 273/371; 273/372; 273/373; 273/374; 273/375; 273/376; 473/578

(58) Field of Classification Search ..... 273/371–376; 340/323 R; 473/578
See application file for complete search history.

(56) References Cited

U.S. PATENT DOCUMENTS 4,793,618 A * 12/1988 Tillery et al. ..... 273/376
4,955,967 A * 9/1990 Houriet et al. ..... 273/372
4,974,857 A * 12/1990 Beall et al. ..... 273/371
5,486,007 A * 1/1996 Stewart et al. ..... 273/374
5,642,886 A * 7/1997 Yancey, Jr. ..... 273/408
5,743,533 A * 4/1998 Wiles et al. ..... 280/5.507
5,971,397 A * 10/1999 Miguel et al. ..... 273/371
6,283,872 B1 * 9/2001 Lichodziejewski et al. ... 473/54
7,207,804 B2 * 4/2007 Hersh ..... 434/236
2004/0121855 A1 * 6/2004 Giegerich ..... 473/371

* cited by examiner

*Primary Examiner*—Robert E. Pezzuto
*Assistant Examiner*—Cameron Saadat
(74) *Attorney, Agent, or Firm*—Akin Gump Strauss Hauer + Feld LLP

(57) ABSTRACT

An electronically-scored game comprises an electronic controller and at least one sensor operatively connected with the controller, the at least one sensor adapted to detect at least one activity associated with the game and to generate a signal. A memory stores information corresponding to a plurality of audible recordings, the memory operatively connected with the controller. A sound generator is operatively connected with the controller. A speaker is operatively connected with the sound generator. Upon detection of the at least one activity associated with the game, the signal from the sensor activates the controller to cause at least one of the plurality of audible recordings to be selected and played by the sound generator through the speaker.

10 Claims, 4 Drawing Sheets

ELECTRONICALLY-SCORED GAME PROVIDING AUDIBLE FEEDBACK AND METHOD OF USE

CROSS-REFERENCE TO RELATED APPLICATIONS

This application claims benefit of U.S. Provisional Patent Application 60/440,708, "Method and Apparatus for Providing Audible Feedback for Game", filed Jan. 16, 2003.

BACKGROUND OF THE INVENTION

The use of electronically scored dart games is well known in the art. Such electronically scored dart games include a dart board comprised of a series of independent polymeric dart board segments, the front face of each of which includes a plurality of circular openings for receiving and capturing the tip of a soft (plastic-tipped) dart or a metal-tipped dart. Upon receiving a dart, the applicable dart board segment moves rearwardly actuating one of a plurality of switches which identifies the particular segment of the dart board which has been hit by the dart. The game includes microprocessor based circuitry for translating information concerning the segment hit by the dart into a score for the particular player whose turn it is. The score is then displayed on a suitable electronic display device. Such electronically scored dart games provide the capability of scoring many different types of dart games depending upon which game is selected to be played.

The present invention is an improvement to an electronically scored dart game and other games such as foosball (table soccer), air hockey (table hockey), basketball games or the like which provide for both positive and negative player feedback in an audible form.

BRIEF SUMMARY OF THE INVENTION

Briefly, the invention is an electronically-scored game comprising an electronic controller and at least one sensor operatively connected with the controller, the at least one sensor adapted to detect at least one activity associated with the game and to generate a signal. A memory stores information corresponding to a plurality of audible recordings, the memory being operatively connected with the controller. A sound generator is operatively connected with the controller. A speaker is operatively connected with the sound generator. Upon detection of the at least one activity associated with the game, the signal from the sensor activates the controller to cause at least one of the plurality of audible recordings to be selected and played by the sound generator through the speaker.

In another aspect, the invention is an electronically scored dart game comprising: a dart board; at least one dart; an electronic controller; and at least one sensor operatively connected with the controller, the at least one sensor adapted to detect a position of impact of the dart on the dart board and to generate a signal corresponding to the position of impact. The invention further comprises a memory storing a plurality of audible recordings, the memory operatively being connected with the controller; a sound generator operatively connected with the controller; and a speaker operatively connected with the sound generator. Upon occurrence of a triggering event, the controller selects at least one of the plurality of audible recordings from the memory and activates the sound generator to play the at least one of the plurality of audible recordings through the speaker.

In yet a third aspect, the invention is a method of playing an electronically-scored dart game, comprising a first step of providing an electronically-scored dart game having: a dart board; at least one dart; an electronic controller; at least one sensor operatively connected with the controller, the at least one sensor adapted to detect a position of impact of the dart on the dart board and to generate a signal corresponding to the position of impact; a memory storing information corresponding to a plurality of audible recordings, the memory operatively connected with the controller; and a sound generator operatively connected with the controller; a speaker operatively connected with the sound generator. Additional steps include impacting the dart board with the at least one dart; sensing the position of the impact on the dart board with the sensor; generating the signal from the sensor to the controller; activating the controller upon occurrence of a triggering event to select at least one audible recording from the memory, and activating the sound generator to play the at least one audible recording through the speaker.

BRIEF DESCRIPTION OF THE SEVERAL VIEWS OF THE DRAWINGS

The following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

The present invention comprises a method and apparatus for providing audible feedback to the player of a game, particularly a game which is electronically or otherwise automatically scored. The present invention will be described in the context of an electronically scored dart game. However, it will be appreciated by those of ordinary skill in the art that the present method and apparatus is equally applicable with respect to any other game which may be electronically or automatically scored. Examples of such other games include foosball, air hockey, electronically scored basketball or virtually any other type of automatically scored game which may be played by one or more players.

The audible feedback provided by the present method and apparatus fits into two categories, namely positive feedback which is provided to a player as a result of good or positive performance and negative feedback or "heckling" which is provided to a player as a result of bad or substandard performance such as missed shots, taking too long to make a shot, low scores or other such less than desirable playing of the game.

Figure 1:
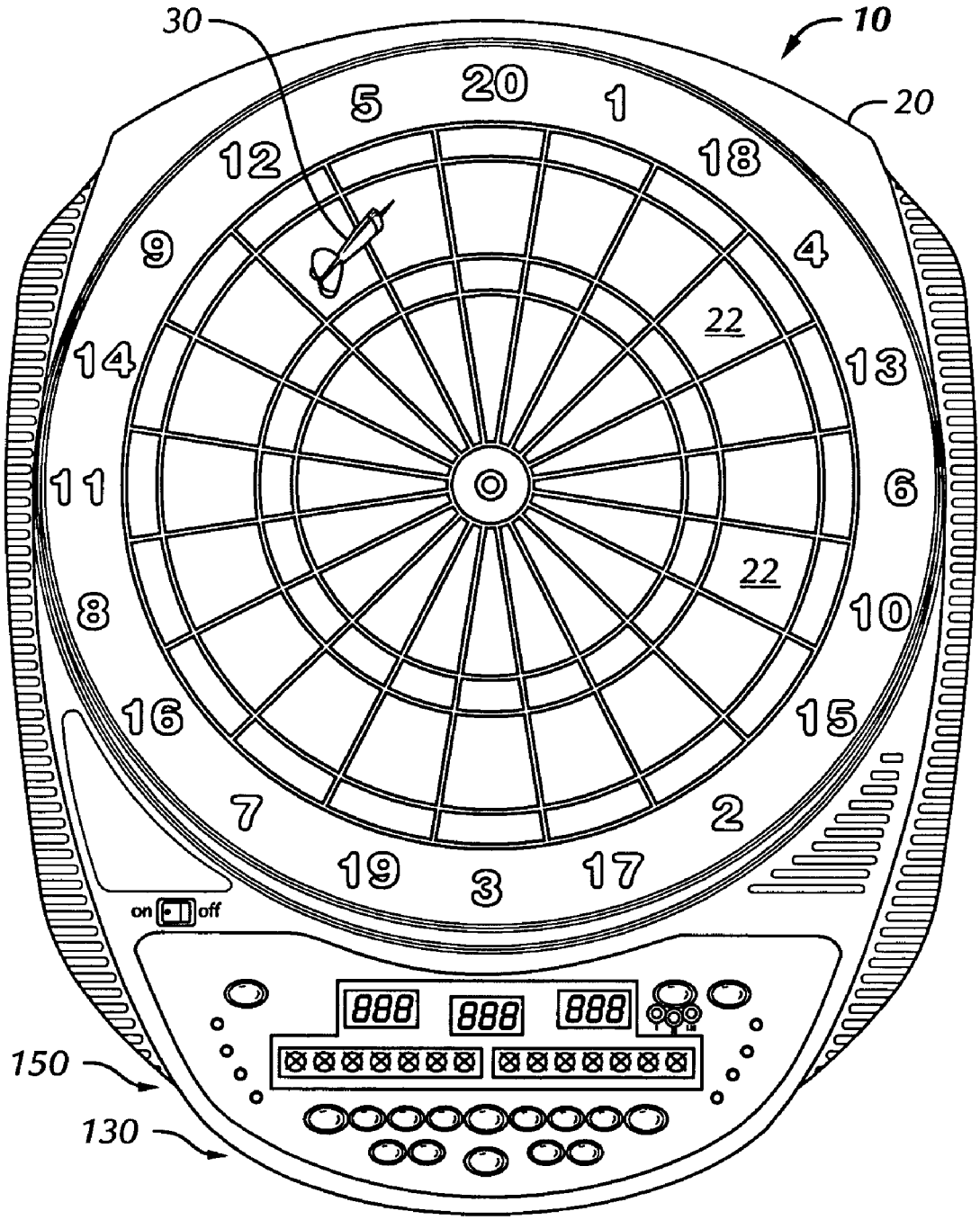
FIG. 1 is a front elevational view of a dart board having an audible feedback apparatus in accordance with a preferred embodiment of the present invention.

FIG. 1 illustrates an electronically-scored dart game 10 comprising a dart board 20 and a. plurality of darts 30.

Figure 2:
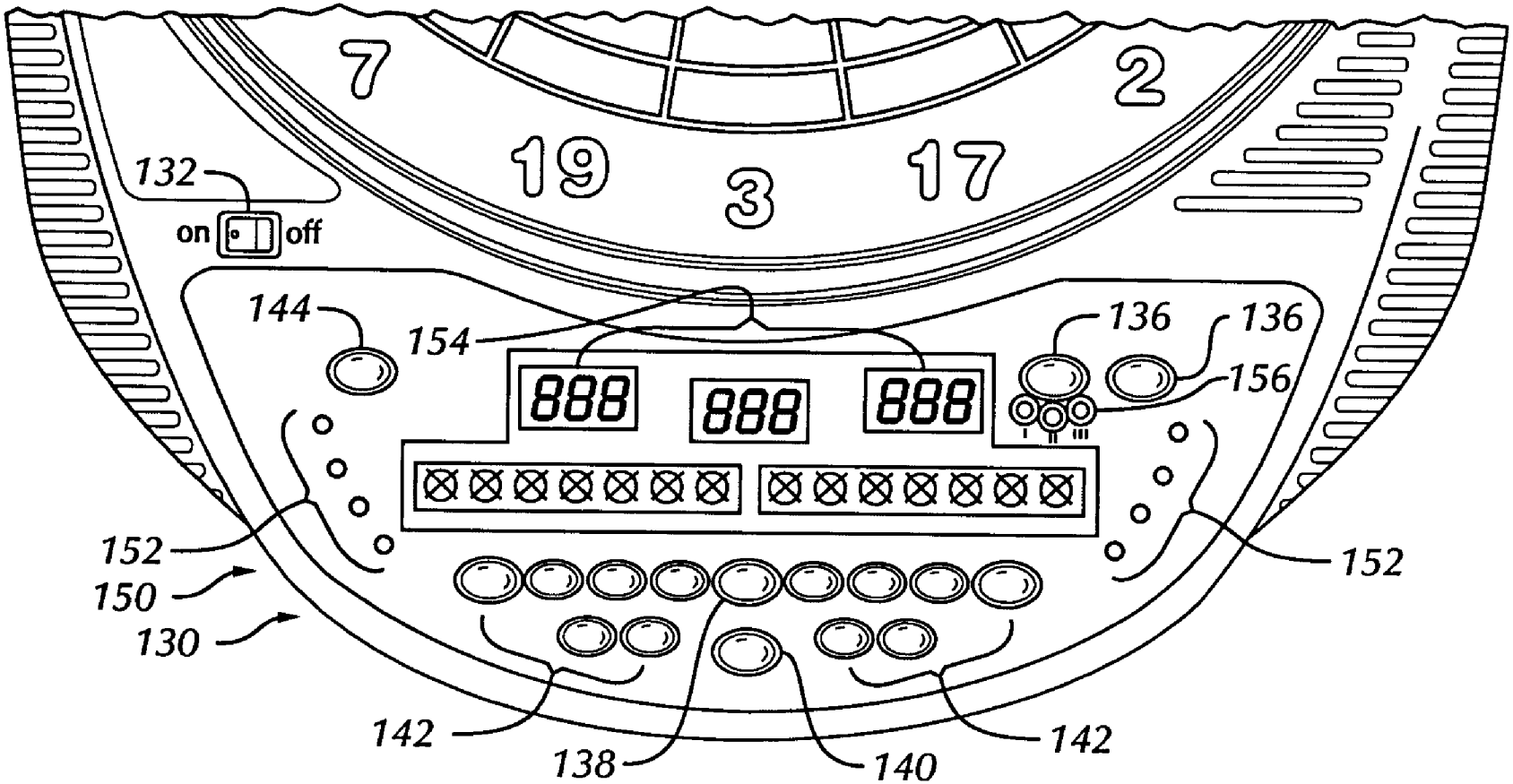
FIG. 2 is a detailed view of a portion of the dart board of FIG. 1, showing electronic controls and displays associated with the present invention.

Except as discussed herein, the dart board 20 is conventional. The dart board 20 includes a plurality of segments 22. The darts 30 may be of any type conventionally used with electronically-scored dart games, for example, soft-tipped type or steel-tipped type darts. Control switches 130 and displays 150 are mounted on one portion of the dart board 20. FIG. 2 is a detailed view of the portion of the dart board 20 having the control switches 130 and displays 150. As seen in FIG. 2, the control switches 130 include a game on/off switch 132, an audible feedback on/off switch 134, a level of difficulty switch 136, a missed dart switch 138, a next player switch 140, game selection switches 142 and a player identification switch 144. The electronic displays 150 include player identification displays 152, score displays 154, level of difficulty displays 156 and a variety of displays specific to specific types of dart games which may be played using the dart game 10.

Figure 3:
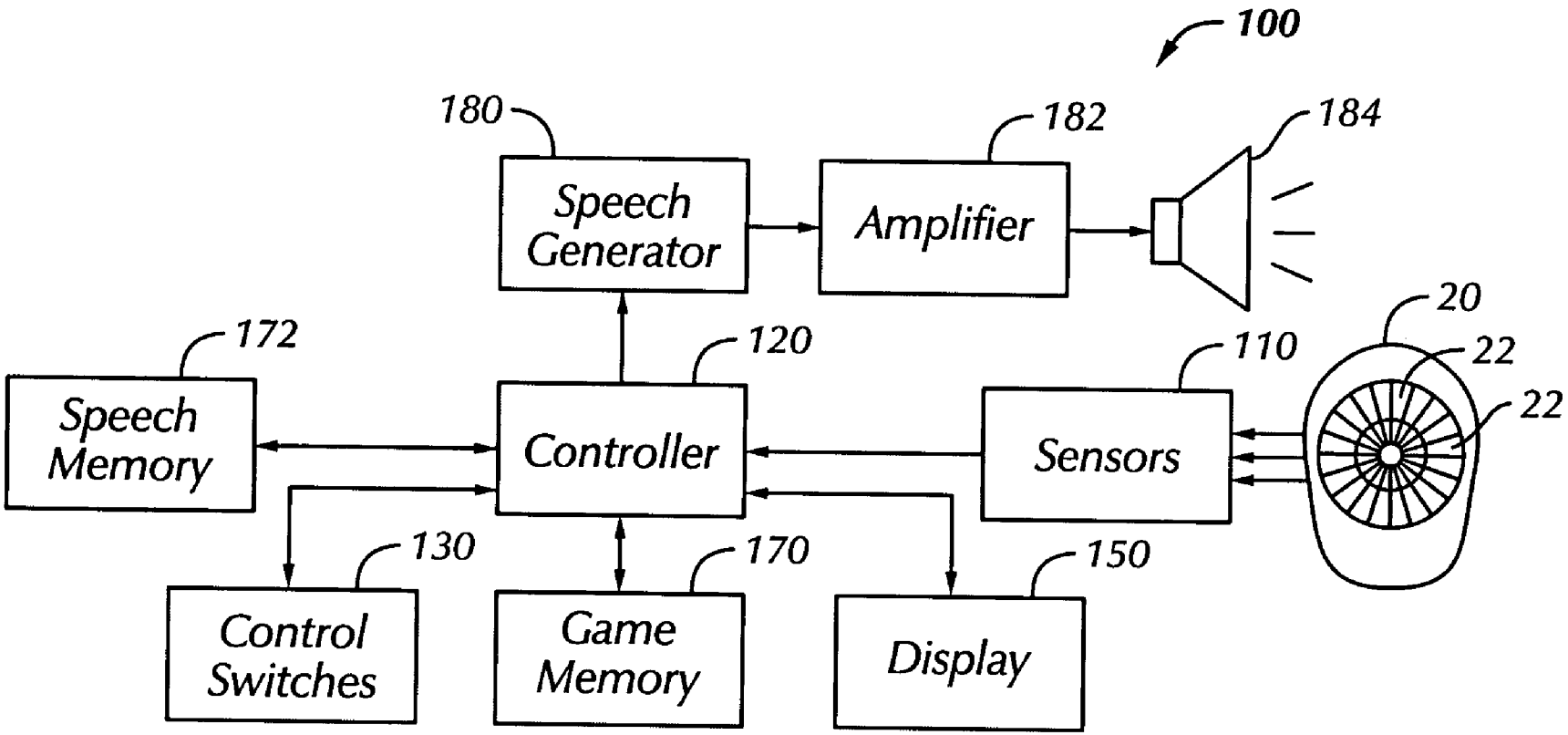
FIG. 3 is a schematic block diagram depicting the audible feedback apparatus of the present invention.

FIG. 3 is a schematic functional block diagram depicting an audible feedback apparatus 100 in accordance with a preferred embodiment of the present invention. The audible feedback apparatus 100 provides both positive and negative audible feedback to a player. As shown in FIG. 3, the apparatus 100 comprises the dart board 20 having the plurality of moveable segments 22. Each of the segments 22 is preferably formed of a moveable member which moves rearwardly when the segment 22 is struck by a dart 30. The apparatus 100 includes a plurality of game sensors 110 which are associated with the game board 20 at the rear of each segment 22 for detecting the movement of a game segment 22 when struck by a dart 30. The sensors 110 are operatively coupled with an electronic game controller 120, the output from each game sensor 110 being sent to the electronic controller 120. The electronic controller 120 typically comprises one or more microprocessors. The game controller 120 has the capability of decoding the output form the game sensor 110 to identify which specific dart game segment 22 was struck by each dart 30 as the dart game 10 is played. From this disclosure, the artisan will recognize that other types of sensors designed to detect an activity associated with the game other than or in addition to impact of the dart 30 on the game segment 22 could be substituted.

The game controller 120 communicates with a game memory 170, the plurality of game control switches 130 and the displays 150. The game control switches 150 are actuated by a player to identify the game to be played as well as to identify when a player has completed his or her turn and other game related functions. The game memory 170 functions with the game controller 120 for effectively monitoring the play of a selected game. The displays 150 are employed for displaying a player's score and other information concerning the game such as which player shoots next, when the game has been completed, who the winner is, etc.

The apparatus 100 as thus forward described, is typical of an electronically scored dart game of the type well known to those of ordinary skill in the art. Further details concerning the structure and operation of the electronically scored dart game are not necessary for a complete understanding of the present invention and may be obtained by referring to information generally available from dart game manufacturers, from prior patents relating to electronically scored dart games and from other publicly available published information.

The present invention comprises an improvement over the prior art electronically scored dart games. The apparatus 100 in accordance with the present invention further comprises a sound memory 172, a sound generator 180, an amplifier 182 and a speaker 184. The sound or speech generator 180 is of a type well known to those of ordinary skill in the art and available from a variety of manufacturers. The sound generator 180 functions by receiving digital signals from the game controller 120 which it converts into audio signals which are then amplified by the amplifier 182 and sounded on the speaker 184. The game controller 120 obtains the digital signals representative of the speech to be played from the speech or sound memory 172 based upon detection of at least one activity associated with the game, for example the quality of how the game is being played, or some other triggering event. Triggering events could include impact of the dart upon the dart board, completion of an individual round of the dart game, achievement of a particular score in a given round; achievement of a particular score in a complete game of darts; completion of a full game of darts, failure to detect impact of the dart within a predetermined period of time, a player exceeding a desired total score, or indication of a thrown dart having missed the dart board.

For example, if a player does something reflecting a favorable quality of activity associated with the game, such as throwing a dart and hitting the segment 22 of the dartboard 20 which is required for a particular dart game, the game controller 120 queries the sound or speech memory 172 for a sound or speech signal indicative of a positive or laudatory response for an individually thrown dart. The appropriate digital signals are received by the game controller 120 from the sound memory 172 and are sent to the sound generator 180 where the digital signals are converted into the corresponding audio signals which are then amplified by the amplifier 182 and sounded by the speaker 184 for the player to hear. Other positive responses are obtained based upon scores in a single round or based upon winning a particular dart game.

Alternatively, if a dart thrown by a player hits a segment 22 of the dartboard 20 which is different than the anticipated segment for the particular dart game being played, the game controller 120 queries the sound memory 172 for a first negative or heckle response which is received and sounded for the player in the same manner as described above. Negative, derisive or heckle responses are generally presented for activity representing a low or unfavorable quality of play, for example, individual missed darts, bad scores in a single round, "busting" in certain games or for the player taking too much time to throw a dart.

Other positive or negative responses may also be presented to a player. For example, a negative response may be played if a player has gone for a long period of time without getting a score or if the score of a particular player is way behind that of another player. Other positive or negative responses will be apparent to those of ordinary skill in the art. The artisan will recognize that the responses can be any of a wide variety of sounds, including spoken passages, musical passages and the like.

Figure 4:
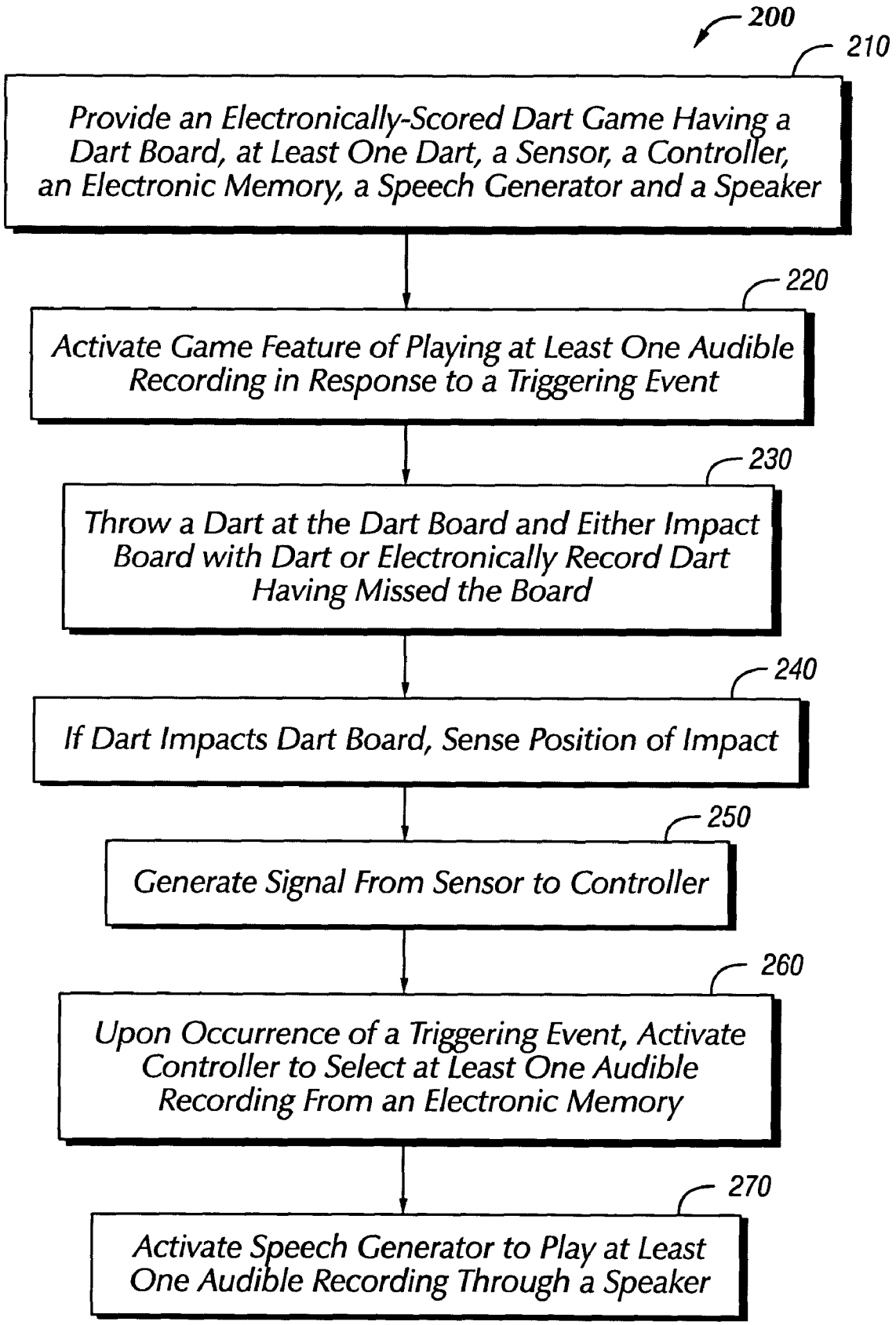
FIG. 4 is a schematic block diagram depicting a method of using the audible feedback apparatus of FIG. 3.

With reference to FIG. 4, a second aspect of the invention is a method of playing an electronically-scored dart game. The method 200 comprises a first step 210 of providing the apparatus 100 described above. In a second step 220, the audible feedback feature is activated by the on/off switch 134. Alternatively, the audible feedback feature could be activated whenever the dart board game on/off switch 132 is activated. In a third step 230, a user throws a dart 30 at the dart board 20, either impacting the dart board 20 or missing the dart board 20. If the dart 30 misses the board 20, the user so indicates using the missed dart switch 138 if such a switch 138 is provided. If the dart 30 impacts one of the segments 22, the position of impact is sensed in a fourth step 240. In a fifth step 250, a signal is generated by the sensors 110 to the controller 120. Upon occurrence of the triggering event as described above, the controller 120 selects at least one audible recording from the sound memory 172 in sixth step 260. Preferably the selection of the at least one audible recording is based at least in part upon the position of the impact. In a seventh step 270, the controller 120 activates the sound generator 180 to play the at least one audible recording through the speaker 184.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An electronically-scored game comprising:

an electronic controller;

at least one sensor operatively connected with the controller, the at least one sensor adapted to detect at least one activity associated with the game and to generate a signal;

a game on/off switch;

a memory storing information corresponding to a plurality of audible recordings, the memory being operatively connected with the controller, at least one of the plurality of audible recordings being of a derisive character;

a game level difficulty input switch to select a level of game difficulty;

a sound generator operatively connected with the controller; and a speaker operatively connected with the sound generator, whereby upon detection of the at least one activity associated with the game, the signal from the sensor activates the controller to cause at least one of the plurality of audible recordings to be selected, dependent at least in part upon the level of game difficulty selected, and played by the sound generator through the speaker, the audible recording played by the sound generator being the derisive audible recording when the quality of the at least one activity of the game is unfavorable.

2. The electronically-scored game of claim 1 wherein the at least one of the plurality of audible recordings selected is of a laudatory character when the quality of the at least one activity associated with the game is favorable.

3. An electronically scored dart game comprising:

a dart board;

at least one dart;

an electronic controller;

a game on/off switch;

at least one sensor operatively connected with the controller, the at least one sensor adapted to detect a position of impact of the dart on the dart board and to generate a signal corresponding to the position of impact;

a memory storing a plurality of audible recordings, the memory being operatively connected with the controller;

an audible feedback on/off switch to activate the audible recordings;

a sound generator operatively connected with the controller;

a speaker operatively connected with the sound generator, whereby upon occurrence of a triggering event, the controller selects at least one of the plurality of audible recordings from the memory and activates the sound generator to play the at least one of the plurality of audible recordings through the speaker, the at least one of the plurality of audible recordings selected being of a derisive character when the triggering event reflects an undesirable quality of play; and a game level difficulty input switch, wherein selection of the at least one of the plurality of audible recordings is based at least in part on a level of game difficulty input by a user.

4. The electronically-scored dart game of claim 3, further comprising:

a game memory adapted to store a player's cumulative score through multiple rounds of a game of darts;

game control switches adapted to allow cumulative scores of multiple players to be stored in the game memory through multiple rounds of the game of darts; and an additional game control switch adapted to allow the players to indicate to the game memory that a thrown dart missed the board, wherein the triggering event is at least one of impact of the dart upon the dart board, completion of an individual round of the dart game, achievement of a particular score in a given round; achievement of a particular score in a complete game of darts; completion of a full game of darts, failure to detect impact of the dart within a predetermined period of time, a player exceeding a desired total score, or indication of a thrown dart having missed the dart board.

5. The electronically-scored dart game of claim 3, wherein selection of the at least one of the plurality of audible recordings is based at least in part upon position of impact of the dart upon the dart board.

6. The electronically-scored dart game of claim 3, wherein the at least one of the plurality of audible recordings selected is of a laudatory character when the triggering event reflects a desirable quality of play.

7. A method of playing an electronically-scored dart game, comprising the steps of:

providing an electronically-scored dart game having:

a dart board;

at least one dart;

an electronic controller in communication with a game on/off switch, an audible feedback on/off switch and a game level difficulty input switch;

at least one sensor operatively connected with the controller, the at least one sensor adapted to detect a position of impact of the dart on the dart board and to generate a signal corresponding to the position of impact;

a memory storing information corresponding to a plurality of audible recordings, wherein at least one of the plurality of audible recordings is of a derisive character, the memory being operatively connected with the controller;

a sound generator operatively connected with the controller;

a speaker operatively connected with the sound generator;

actuating the game on/off switch to turn the game on;

actuating the audible feedback on/off switch to activate the sound generator and the speaker;

actuating the game level difficulty input switch;

impacting the dart board with the at least one dart;

sensing the position of the impact on the dart board with the sensor;

generating the signal from the sensor to the controller;

activating the controller upon occurrence of a triggering event to select at least one audible recording from the memory, which takes into account a quality of the impact depending upon the electronically-scored dart game being played and a level of game difficulty input by a user with the game level difficulty input switch; and activating the sound generator to play the audible recording of the derisive character through the speaker when the quality of the impact is unfavorable.

8. The method of playing an electronically-scored dart game of claim 7, wherein: the electronically-scored dart game further includes:

a game memory capable of tracking scores of multiple players through multiple rounds of a game of darts;

a missed dart input switch allowing a user to record a thrown dart having missed the dart board; and the method further comprises the step of a player recording a thrown dart having missed the dart board using the missed dart input switch.

9. The method of playing an electronically-scored dart game of claim 8, wherein the triggering event is impact of the dart upon the dart board, completion of an individual round of the dart game, achievement of a particular score in a given round;

achievement of a particular score in a complete game of darts; completion of a full game of darts, failure to detect impact of the dart within a predetermined period of time, a player exceeding a desired total score, or indication of a thrown dart having missed the dart board.

10. The method of playing an electronically-scored dart game of claim 7, wherein the at least one of the plurality of audible recordings selected from the memory is selected based at least in part upon the position of impact.

* * * * *